US006287181B1

(12) United States Patent
Dekok et al.

(10) Patent No.: US 6,287,181 B1
(45) Date of Patent: Sep. 11, 2001

(54) UNIVERSAL POLISHING HEAD

(75) Inventors: Peter T. Dekok, Atlanta; Michael D. Brown, Elberton, both of GA (US)

(73) Assignee: GranQuartz, L.P., Tucker, GA (US)

( * ) Notice: Subject to any disclaimer, the term of this patent is extended or adjusted under 35 U.S.C. 154(b) by 0 days.

(21) Appl. No.: 09/578,336

(22) Filed: May 25, 2000

Related U.S. Application Data

(63) Continuation of application No. 08/954,782, filed on Oct. 21, 1997, now abandoned.

(51) Int. Cl.[7] ..... B24B 7/00; B28D 1/00
(52) U.S. Cl. ..... 451/353; 451/548; 125/25
(58) Field of Search ..... 451/353, 342, 451/359, 350, 548; 125/25

(56) References Cited

U.S. PATENT DOCUMENTS

| | | | | |
|---|---|---|---|---|
| 1,698,970 | | 1/1929 | Shaff . | |
| 1,980,491 | * | 11/1934 | Mall | 451/353 |
| 1,984,205 | * | 12/1934 | Vinella | 451/342 |
| 2,629,990 | | 3/1953 | Tocci-Guilbert . | |
| 2,633,008 | | 3/1953 | Tocci-Guilbert . | |
| 2,716,312 | | 8/1955 | Speicher . | |
| 2,717,478 | * | 9/1955 | Blum | 451/342 |
| 2,767,527 | | 10/1956 | Tocci-Guilbert . | |
| 2,860,496 | * | 11/1958 | Tocci-guilbert | 451/342 |
| 2,882,652 | | 4/1959 | Owen . | |
| 2,883,805 | | 4/1959 | Limbers . | |
| 3,041,793 | | 7/1962 | Shimizu . | |
| 3,934,377 | * | 1/1976 | Tertinek | 451/353 |
| 5,184,429 | * | 2/1993 | Parsons | 451/353 |

FOREIGN PATENT DOCUMENTS 2 172 823 A 10/1986 (GB) .

* cited by examiner

*Primary Examiner*—Robert A. Rose
(74) *Attorney, Agent, or Firm*—Rodgers & Rodgers

(57) ABSTRACT

A stone polishing head for use on a conventional automatic polishing machine which is simple, but has the weight and strength of a prior art polishing head for which the machine was designed. The polishing head is formed of a solid steel barrel having a central bore for coolant flow. On the bottom surface of the barrel a first plate is fixed, and a drive plate is resiliently fixed adjacent to the plate. A tool carrier plate is releasably fixable to the drive plate for rotation with the barrel. The plates are connected by a plurality of connecting pins to maintain the plates parallel to each other.

13 Claims, 4 Drawing Sheets

UNIVERSAL POLISHING HEAD

This is a continuation of application Ser. No. 08/954,782 filed Oct. 21, 1997 now abandoned.

BACKGROUND OF THE INVENTION

This invention relates generally to the finishing of stone, and is more particularly concerned with a polishing head that can be used for all stages of the polishing procedure, and for all kinds of stone. The usual stone polishing arrangement comprises a flat plate equipped with specialized restraining device that receive abrasive bricks. Such an arrangement is known as a Frankfurt plate and can successfully polish marble, sandstone and limestone.

To polish granite, specialized heads have been required, the head being quite complex. Such specialized heads are shown in the U.S. Pat. No. 4,965,965 to Wallin et al. and U.S. Pat. No. 5,151,331 to Zambon. In both these devices, it will be noted that the abrasives are carried by pivoted arms that rock. As a result, the abrasive wears to a rounded surface and makes only line contact with the stone being polished.

In general, granite is not homogenous but is made up of hard quartz crystals cemented together by a softer surrounding matrix. Known devices embody resiliently mounted abrasive plates which tend to tilt thereby causing the cutting element to touch the stone surface at the leading and trailing edges. This results in unwanted distortion of the surface of the stone. For instance, U.S. Pat. No. 2,717,478 to Blum and U.S. Pat. No. 2,860,496 to Tocci-Guilbert include grinding elements which could tilt and dig into the stone's surface.

SUMMARY OF THE INVENTION

The present invention provides a stone polishing head that has a heavy barrel attachable to a conventional automatic polishing machine. The barrel approximates the weight of the head the polishing machine is intended to carry. The lower end of the polishing head mounts a drive plate, the drive plate in turn mounting an abrasive carrier having a plurality of abrasive segments thereon. The polishing head of the present invention holds the abrasive plate substantially flat during use for maximum effectiveness of the abrasive segments. This is accomplished by at least two parallel plates interconnected by connecting pins with resilient material interposed between the plates.

BRIEF DESCRIPTION OF THE DRAWINGS

These and other features and advantages of the present invention will become apparent from consideration of the following specification when taken in conjunction with the accompanying drawings in which.

DESCRIPTION OF THE PREFERRED EMBODIMENTS

Figure 1:
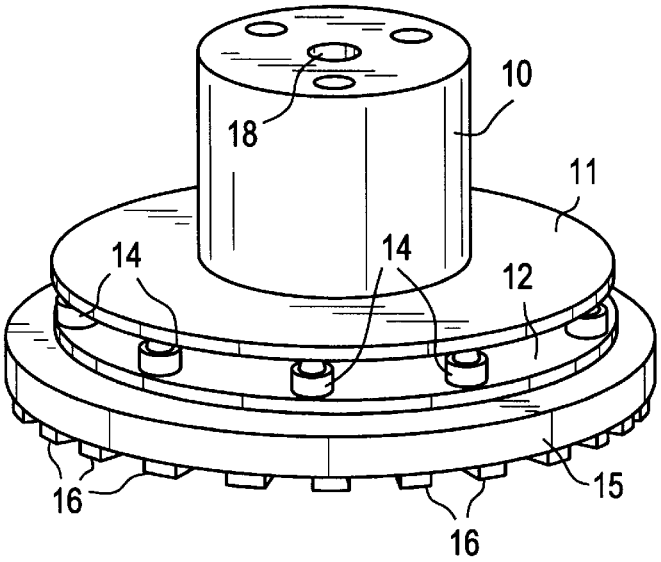
FIG. 1 is a perspective view showing a polishing head made in accordance with the present invention.

Referring now more particularly to the drawings and to those embodiments of the invention here chosen by way of illustration, the device shown in FIG. 1 includes a barrel 10 having a plate 11 fixed to its lower end. Spaced below the plate 11 is a second plate 12, the plate 12 being a drive plate. Between the drive plate 12 and the upper plate 11 there is a resilient means, here shown as including a plurality of shock absorbers 14. Selectively fixable to the drive plate 12 is a tool carrier 15, the tool carrier 15 having a plurality of tools 16 fixed to its lower surface.

It should be understood that the barrel 10 is solid steel, having an axial bore 18 through which coolant is delivered to the abrasive tools 16. The upper plate 11 and drive plate 12 are also solid steel, and include the central bore to allow coolant to pass there through and contact the abrasive tools 16. The device of the present invention is designed to replace a large and heavy apparatus such as that shown in the above mentioned patents to Wallin et al. or Zambon; thus, it is important to provide comparable weight. Since the automatic polishing machine is designed to receive a heavy polishing head, the balance and drive do not work well if the head is too light in weight.

Further, automatic polishing machines are rather powerful, so the device of the present invention must be strong enough to deliver the power to the abrasive tools without being destroyed or distorted. Again, the solid steel barrel provides the strength necessary.

Whereas the prior art polishing heads can generally be used on the softer stones such as sandstone, limestone and marble, but not on granite, the polishing head of the present invention can be used on all stones, including granite. Furthermore, in utilizing the present invention, the same device can be used with the coarsest grit and the finest grit.

Figure 2:
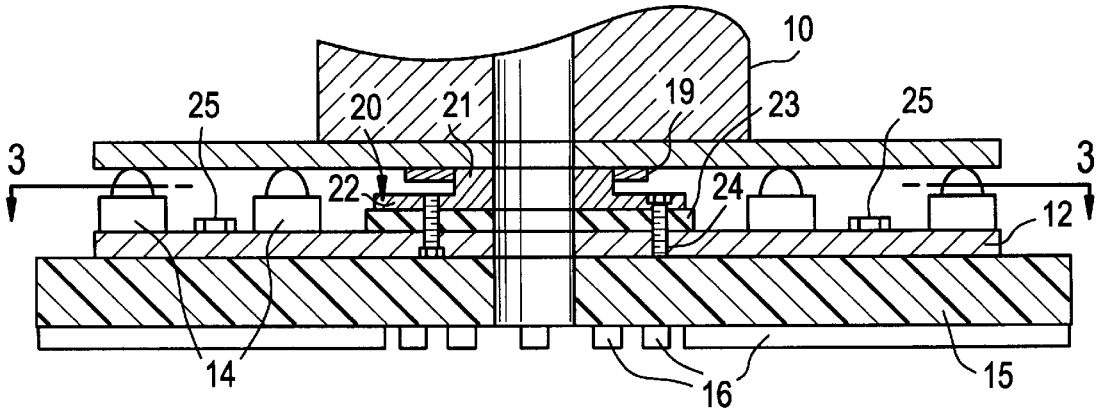
FIG. 2 is a diametrical cross-sectional view of the device shown in FIG. 1, the upper portion of the barrel being broken away.

Attention is directed to FIG. 2 of the drawing for a better understanding of the construction of the device of the present invention. It will be seen that the upper plate 11 is shown as fixed to the barrel 10. No specific fastening means is shown, but those skilled in the art will understand that the plate can be fastened by screws, welding or the like.

Centrally of the upper plate 11 there is a ring 19 fixed concentrically with the plate 11 and bore 18. The ring 19 receives a connector 20 having a neck 21 fixed to the ring 19 and a flange 22 of larger diameter than the neck 21. A plurality of screws 24 pass through the flange and through the drive plate 12 to hold the drive plate 12 to the device; and, there is an elastomeric member 23 between the connector 20 and the drive plate 12. The elastomeric member 23 allows some freedom of movement, or floating, of the drive plate 12. The shock absorbers 14 control the floating movement of the plate 12.

Those skilled in the art will understand that the tool carrier 15 is preferably easy to remove and install because the abrasive tools 16 become worn out and they must be replaced; also, during the polishing process one generally starts with a somewhat coarse grit, and changes to finer grits as the polishing process proceeds. Thus, one must relatively frequently change the tool carrier 15.

Figure 3:
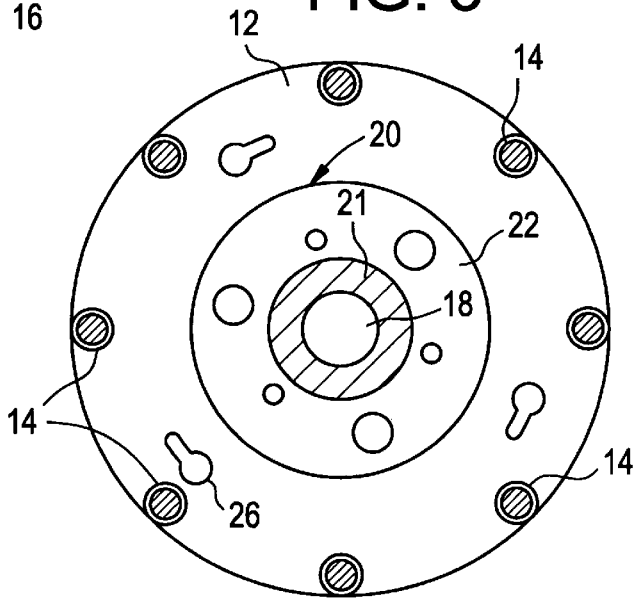
FIG. 3 is a cross-sectional view taken along the line 3—3 in FIG. 2.

For ease in changing the tool carrier 15, the tool carrier has a plurality of bolts 25 extending upwardly therefrom. The tool carrier 15 is here indicated as formed of a polymeric material. Other materials may be used, but the polymeric materials tend to be light in weight and easy to handle, and further are more economical than steel or the like. The drive plate 12 has complementary keyhole slots 26, shown in FIG. 3 of the drawings. Thus, to install the tool carrier, the bolts 25 are aligned with the large portion of the keyhole slot and the tool carrier is urged up against the drive plate. Rotation of the tool carrier will then lock it in place. To remove the tool carrier, the steps are reversed.

Figure 4:
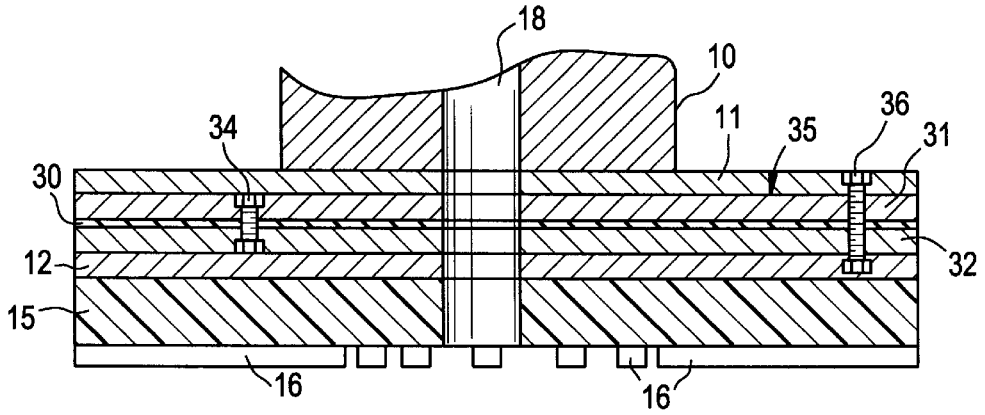
FIGS. 4 and 5 are views similar to FIG. 2 but showing modified forms of the invention.

Looking at FIG. 4 of the drawings, it will be understood that the device is substantially the same as the device shown in FIG. 2, except that the resilient means has been changed. In the device of FIG. 4, the resilient means 30 is simply a sheet of rubber or other elastomeric material. The sheet 30 will have a thickness substantially equal to the amount of float desired for the polishing head; so, the sheet 30 may have a thickness of around 1 mm or 1/16 inch.

In order to simplify installation of the resilient means, FIG. 4 illustrates a pair of plates 31 and 32 sandwiching the sheet 30 therebetween. The pair of plates is effectively a packaging for the resilient means and may be held together by a plurality of screws such as the screw 34 to yield a total package generally designated at 35. The package 35 is held between the upper plate 11 and the drive plate 12 by screws such as the screw 36.

Figure 5:
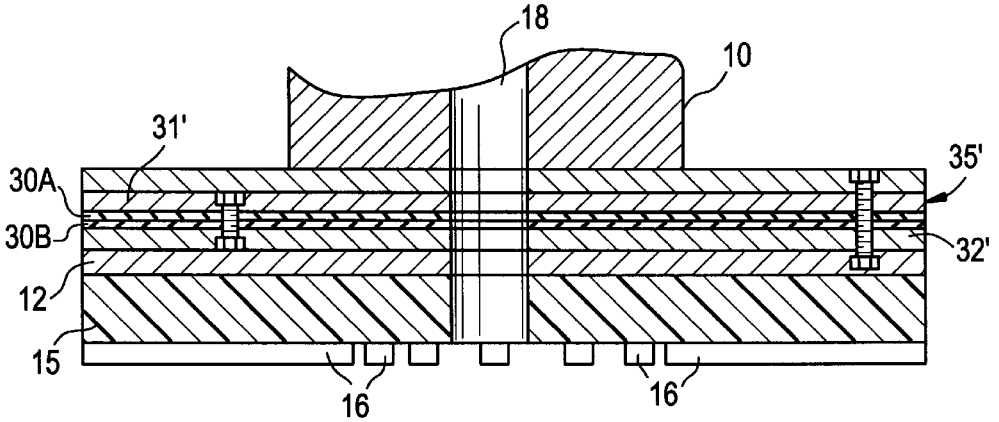

Looking next at FIG. 5 of the drawings, it will be noticed that this device is like the device of FIG. 4, except that there are two sheets of resilient material 30A and 30B between plates 31' and 32' which create a package 35'. The use of two sheets instead of one simply increases the amount of float for the abrasive carrier 15, and those skilled in the art will understand that the number of sheets, and the thickness of the sheets, may be varied to achieve the desired degree of float.

It has been found that, when a stone to be polished has a concave surface, if the polishing head is allowed to float, or tilt, too much when the head is grinding the higher portion of the stone, the head will gouge lower portions of the stone. Thus, it is important to control the amount of float of the head. Depending on the particular configuration of the stone to be ground, the float may be as much as about ½ inch, or 2 cm, and may be a little as about 1/32 inch or 1 mm. for the first stage grinding, the optimum float may be about 1 mm to control the head closely. For the subsequent stages, the float can be increased somewhat, perhaps to 2 or 3 mm. Again, those skilled in the art will understand that the amount of float can be varied depending on the particular circumstances.

Figure 6:
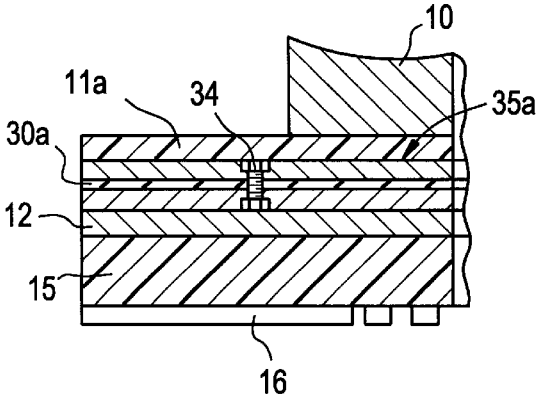
FIG. 6 is a fragmentary cross-sectional view showing a further modified form of the invention.

FIG. 6 illustrates a slightly different embodiment of the invention. Rather than a steel plate 11 fixed to the barrel 10, the embodiment of FIG. 6 utilizes a plate 11*a* made of a polymeric material. The resilient material 30*a* is in place as described in connection with FIG. 4, the resilient material being in the package 35*a*. A polymeric material that has been successful as the plate 11*a* is polyvinyl chloride. Those skilled in the art will realize that vinyl is an elastomeric material and other polymeric elastomers will work as well. Thus, one might utilize an ultra high molecular weight polyethylene, a rigid polyurethane, acrylonitratebutadiene styrene or other material having some elastomeric properties.

Figure 7:
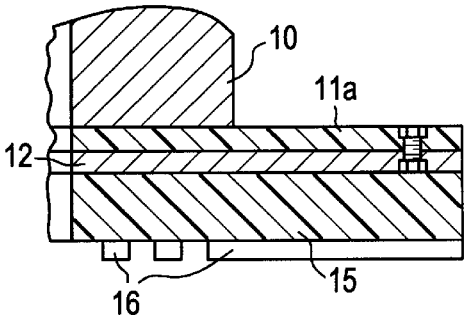
FIG. 7 is a view similar to FIG. 6 and showing a further modification for limited use.

In FIG. 6, the only change in the device is to replace the steel plate 11 with the polymeric plate 11*a*. FIG. 7 shows a further modification wherein the resilient material 30 has been omitted. In this embodiment of the invention the only floating of the drive plate 12 is due to the resilience of the plate 11*a*. Since the resilience of the plate 11*a* is small, the apparatus shown in FIG. 7 is for very limited purposes. The device can be used in the first pass over the stone to be polished, when a small degree of floating is preferable. After the stone has been partially dressed and is nearly flat, one could insert the resilient material 30, for example in the package 35, to complete the polishing of the stone.

Figure 8:
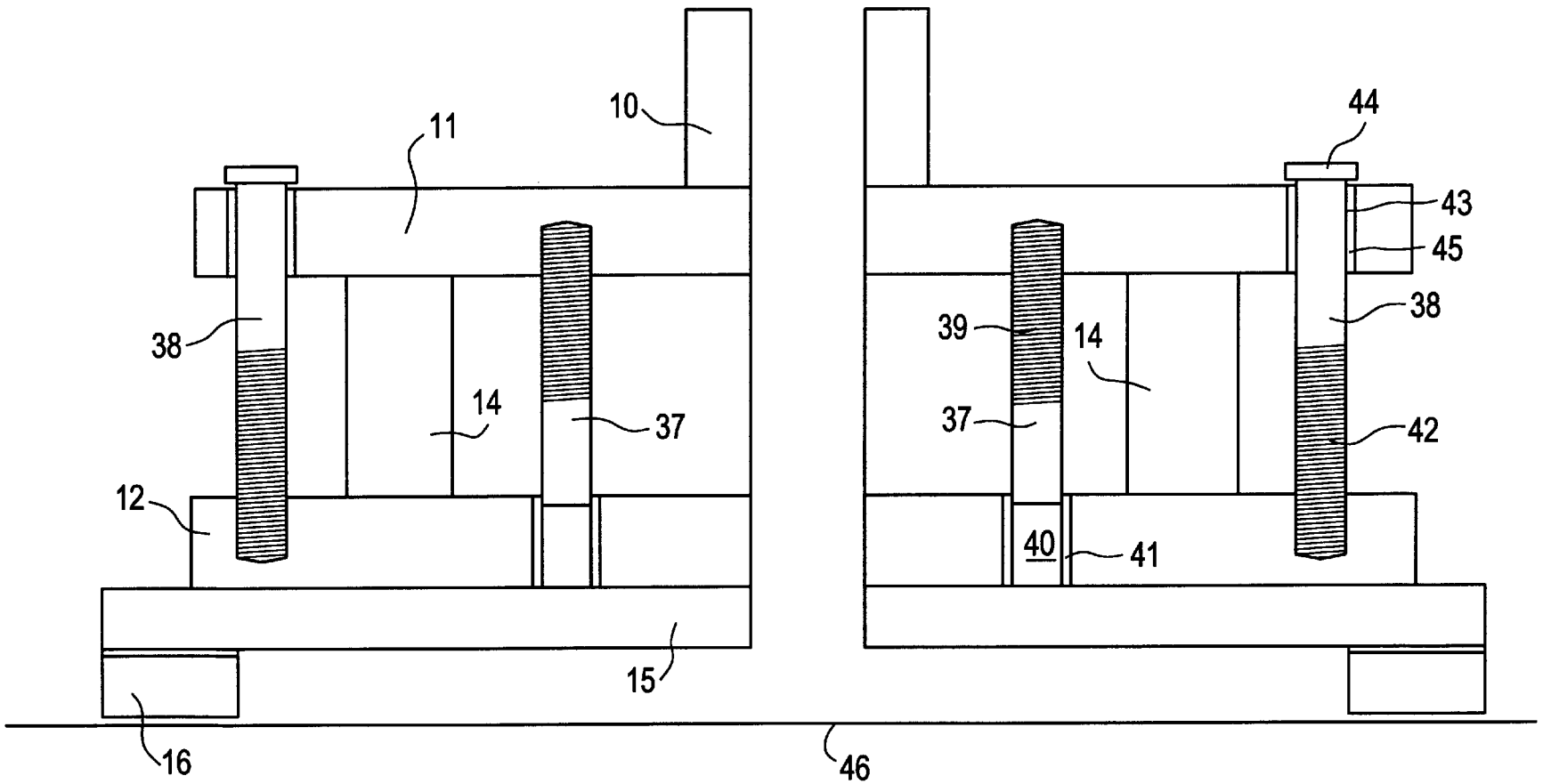
FIG. 8 is a cross-sectional schematic view showing a modification of the invention.
Figure 9:
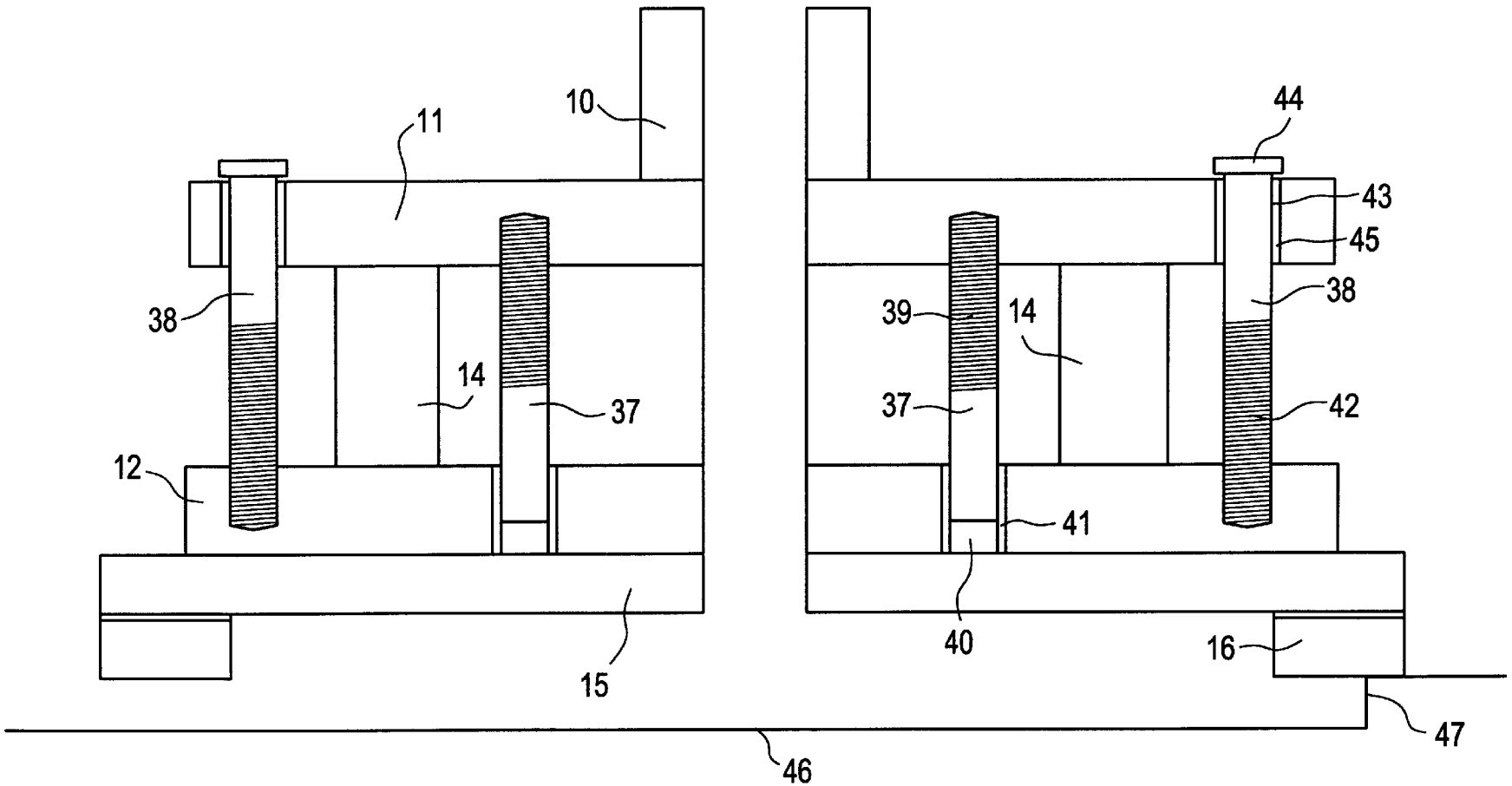
FIG. 9 is a view similar to FIG. 8 depicting the head in an operational configuration.

A modified form of the invention is shown in FIGS. 8 and 9 wherein, in FIG. 8, the device includes barrel 10 having plate 11 fixed to its lower end and drive plate 12 spaced therebelow with resilient material 14 disposed therebetween. Tool carrier plate 15 is fixed to drive plate 12 by conventional means with a plurality of tools 16 fixed to the lower surface thereof with the totality thereof comprising the abrasive apparatus.

According to this form of the invention, plates 11 and 12 are connected by a plurality of interconnecting pins in the form of an inner ring of six studs 37 and an outer ring of nine bolts 38. Each stud 37 is threadedly interconnected to plate 11 by means of threads 39 and is slidably disposed in aperture 40 formed in plate 12. In order to insure a close tolerance between stud 37 and plate 12, sleeve 41 is interposed between the lower portion of stud 37 and the surrounding portion of plate 12. To insure that plates 12 and 15 are maintained in a horizontal plane, resilient material 14 is interposed between the inner ring of studs 37 and outer ring of bolts 38.

In similar fashion, bolts 38 are interconnected to plate 12 by means of threaded portion 42. The upper portion of bolt 38 is slidably disposed in aperture 43 formed in plate 11. In order to prevent the abrasive apparatus from separating from plate 11, conventional hexagonal head 44 is formed on the top of bolt 38 and, in order to provide a close tolerance between bolt 38 and plate 11, sleeve 45 is provided and is disposed between the upper portion of bolt 38 and the surrounding surface of plate 11.

As the device depicted in FIGS. 8 and 9 glides over the stone surface 46, tools 16 will eventually encounter an irregularity or high place 47 thus causing the device to be lifted upwardly, essentially as shown in FIG. 9. Due to the resilient mounting means of known devices, the cutting portion opposite the point of contact with the high place will be caused to tilt downwardly thereby gouging or digging into surface 46 of the stone.

This undesirable result is eliminated by this invention wherein plates 11, 12 and 15 are always maintained in a parallel fixed relationship to each other and also parallel to the surface of the stone. Since the device according to this invention does not tilt, any gouging of the stone is eliminated. As irregularity 47 is ground down, tools 16 come into contact selectively with stone surface 46 until the surface reaches a completely smooth condition.

Resilient material 14 is necessary because the original stone surface can deviate as much as 5 mm. The cutting material is not capable of removing 5 mm of granite in one pass. Therefore resilient material 14 allows plates 11, 12 and 15 to compress thereby allowing multiple passes of the device over the stone surface.

It will, therefore, be understood that the present invention provides a polishing head that can be used on virtually any polishing machine, and on any stone from sandstone to granite. The solid steel barrel 10 provides enough weight that the polishing machine acts the way it was designed to act; and, the barrel gives enough strength to withstand the forces of large automatic polishing machines.

Because the drive plate 12 and tool carrier 15 are maintained in positions parallel to the surface of the stone being polished, the polishing head can be used on stones that do not have a completely flat surface. The tool carrier can appropriately grind the high points of the surface without gouging the lower points.

It will of course be understood by those skilled in the art that the particular embodiments of the invention here presented are by way of illustration only, and are meant to be in no way restrictive, therefore, numerous changes and modifications may be made, and the full use of equivalents resorted to, without departing from the spirit or scope of the invention as outlined in the appended claims.

We claim:

1. A stone polishing head for use on an automatic polishing machine normally carrying a head having a given weight, said polishing head comprising a barrel selectively mountable on said polishing machine and having an upper surface attachable to said polishing machine and a lower surface, a circular first plate fixed to said lower surface of said barrel and concentric therewith, abrasive apparatus spaced below said first plate, resilient means disposed between said first plate and said abrasive apparatus, a connecting pin arrangement interconnecting said first plate and said abrasive apparatus, said connecting pin arrangement comprising a bolt, an elongated aperture formed in said first plate, and said bolt being slidably disposed within said aperture in a direction coincidental with the axis of said aperture and being interconnected with said abrasive apparatus.

2. A stone polishing head according to claim 1 wherein said abrasive apparatus comprises a tool carrier plate having an upper surface and a lower surface with abrasive tools attached to the lower surface thereof and a drive plate fixed to the upper surface thereof.

3. A stone polishing head, for use on an automatic polishing machine normally carrying a head having a given weight, said polishing head comprising a barrel selectively mountable on said polishing machine and having an upper surface attachable to said polishing machine and a lower surface, a circular first plate fixed to said lower surface of said barrel and concentric therewith, abrasive apparatus spaced below said first plate, a ring of multiple bolts fixed to said abrasive apparatus and slidably receivable in said first plate, a ring of multiple studs fixed to said first plate and slidably receivable in said abrasive apparatus, and resilient means disposed between said first plate and said abrasive apparatus and further disposed between said ring of bolts and said ring of studs.

4. A stone polishing head according to claim 1 wherein a sleeve is disposed in said aperture between said bolt and said first plate and extends substantially the length of said aperture.

5. A stone polishing head according to claim 1 wherein an aperture is formed in said abrasive apparatus and wherein said connecting pin arrangement comprises a stud slidably disposed within said aperture at one end thereof and interconnected to said first plate at the other end thereof.

6. A stone polishing head according to claim 5 wherein a sleeve is interposed between said stud and said abrasive apparatus.

7. A stone polishing head according to claim 1 wherein said bolt comprises a head formed on the upper surface thereof to prevent said abrasive apparatus from separating from said first plate.

8. A stone polishing head, for use on an automatic polishing machine normally carrying a head having a given weight, said polishing head comprising a barrel selectively mountable on said polishing machine and having an upper surface attachable to said polishing machine and a lower surface, a circular first plate fixed to said lower surface of said barrel and concentric therewith, a circular drive plate below said first plate and concentric therewith, a circular tool carrier below said drive plate and fixed thereto, resilient means for connecting said drive plate to said first plate and for allowing controlled floating of said drive plate and said tool carrier with respect to said first plate, said resilient means being disposed substantially at the periphery of said first plate, a ring fixed concentrically to said first plate, a connector fixed to said ring, and an elastomeric member disposed between said connector and said drive plate.

9. A stone polishing head according to claim 8 wherein said connector comprises a neck fixed to said ring and a flange of larger diameter than said neck.

10. A stone polishing head according to claim 8 wherein said tool carrier is selectively fixable to said drive plate.

11. A stone polishing head according to claim 8 wherein said barrel has a weight approximately equal to said given weight of said head.

12. A stone polishing head according to claim 8 wherein said resilient means includes a plurality of shock absorbing means located peripherally of said first plate and said drive plate.

13. A stone polishing head according to claim 8 wherein said connector and said drive plate are interconnected by at least one screw.

* * * * *